US009050629B2

(12) United States Patent
Thielepape et al.

(10) Patent No.: US 9,050,629 B2
(45) Date of Patent: Jun. 9, 2015

(54) STONE SEPARATOR WITH AIR SEPARATOR

(71) Applicant: Komptech Umwelttechnik Deutschland GmbH, Oelde (DE)

(72) Inventors: Bernd Thielepape, Bueckeburg (DE); Joerg Brinkschmidt, Loehne (DE)

(73) Assignee: Komptech Umwelttechnik Deutschland GmbH, Oelde (DE)

( * ) Notice: Subject to any disclaimer, the term of this patent is extended or adjusted under 35 U.S.C. 154(b) by 0 days.

(21) Appl. No.: 14/286,570

(22) Filed: May 23, 2014

(65) Prior Publication Data

US 2014/0346098 A1 Nov. 27, 2014

(30) Foreign Application Priority Data

May 24, 2013 (DE) ..... 10 2013 008 867

(51) Int. Cl.
*B07B 4/02* (2006.01)
*B07B 13/10* (2006.01)
*B07B 9/02* (2006.01)

(52) U.S. Cl.
CPC .... *B07B 4/02* (2013.01); *B07B 9/02* (2013.01)

(58) Field of Classification Search
CPC ..... B07B 4/20; B07B 9/02
USPC ..... 209/639, 643, 644
See application file for complete search history.

(56) References Cited

U.S. PATENT DOCUMENTS 3,738,483 A * 6/1973 MacKenzie ..... 209/44.1
3,749,240 A * 7/1973 Spears et al. ..... 209/631
8,910,798 B2 * 12/2014 Benjamins ..... 209/691

FOREIGN PATENT DOCUMENTS

DE 10 2005 008 210 A1 8/2006
DE 20 2009 007 323 U1 11/2010
JP 11-262732 A 9/1999

OTHER PUBLICATIONS

German Office Action dated Apr. 2, 2014 (two pages).

* cited by examiner

*Primary Examiner* — Terrell Matthews
(74) *Attorney, Agent, or Firm* — Crowell & Moring LLP

(57) ABSTRACT

A device for processing a material mixture, with a first conveyor belt which is connected to a chamber, has at least one pressure blower provided in the internal space of the chamber for generating an airflow aimed from below at the material mixture falling into the chamber. At least two collectors are arranged offset along the chamber floor at different distances to the entry point of the material mixture which faces the chamber. These collectors are delimited from one another in terms of surface area by at least one separating crest, which is movably arranged on the chamber floor and extends from the chamber floor in the direction of the chamber upper side. A first material group, such as stones and/or inert materials and/or heavy parts, with the lowest fluid resistance of all material groups of the material mixture, is separable at least to some extent from the material flow in a first separation region, in which a fluid flow and a material mixture flow through the device. In a second separation region with a settling zone and a first negative pressure region, a second material group is separable, at least to some extent.

7 Claims, 2 Drawing Sheets

STONE SEPARATOR WITH AIR SEPARATOR

BACKGROUND OF THE INVENTION

The present invention relates to a stone separator with an air separator for processing a material mixture, and to a separation method.

Such devices are known from the prior art, and are used for processing material mixtures, such as biomass, in which foreign bodies, e.g. stones, foils or similar components, contained in the biomass are separated. For example, it is known to use the different falling behaviors of the different components of the material mixture or, for example, to suction different components by means of blowers or suction devices and use the different fluid dynamic behavior of the components for their separation.

SUMMARY OF THE INVENTION

It can be problematic if, e.g., stones are situated on top of components, such as foils or other light materials, to be suctioned by a suction device and said components can thus no longer or sufficiently be suctioned off. It can generally be problematic to separate stones, inert materials and/or heavy parts which can be situated, as described, on top of the light materials from the input fraction or the material mixture introduced into the device.

Therefore, the problem addressed by the present invention is that of providing an improved device for processing a material mixture which overcomes the aforementioned disadvantages.

According to the invention, this problem is solved by a device for processing a material mixture that separates stones, inert materials and/or heavy parts with a first conveyor belt which is connected to a chamber. At least one pressure blower is provided in the internal space of the chamber for generating an airflow aimed from below at the material mixture falling into the chamber, and at least two collecting means are arranged offset along the chamber floor at different distances to the entry point of the material mixture which faces the chamber. The collecting means are delimited from one another in terms of surface area by at least one separating crest which is movably arranged on the chamber floor and extends from the chamber floor in the direction of the chamber upper side. A first material group, such as stones and/or inert materials and/or heavy parts, with the lowest fluid resistance of all material groups of the material mixture, is separable at least to some extent from the material flow in a first separation region, and a fluid flow and a material mixture of at least three different material groups, separable by means of the device, flow as material flow through the device. In a second separation region with a settling zone and a first negative pressure region, a second material group is separable in a horizontally lateral direction from a main direction of the material flow and the settling zone at least to some extent by means of the first negative pressure region.

For suctioning the lighter material flow components, it is advantageous that they, together with the fluid flow, are slowed down in their movement and guided in the settling zone of the second separation region downstream of a fluid guide plate or a plurality of fluid guide plates and thus easier to separate from the material flow by means of the first negative pressure region. No or only minor turbulences occur in the region of the stones and/or inert materials, and so no light materials can flow back into the fraction or material group of the stones/inert materials/heavy parts. Furthermore, the suctioning in the region of the first negative pressure region is essential for the targeted airflow within the device. The first negative pressure region and/or the suction fan associated with the first negative pressure region is thus used for the necessary airflow and the first separation of light materials, foils, etc.

The term "fluid resistance" refers to the tendency of the individual material groups to be carried along by a fluid flow. It is particularly influenced by the drag coefficient and the density of the material groups or their components.

In a preferred embodiment, it is conceivable that at least a second conveyor belt, at least one fluid guide plate, a second negative pressure region, and overall at least four separation regions are provided.

The overall at least four separation regions allow for a qualitatively better separation of the material mixture into the different material groups. As will be described in the following, different separation methods are combined such that as low as possible an effort is required for achieving the desired separation results.

The term "fluid guide plate" refers to a section of the device for the targeted airflow which is designed to guide the material flow and the fluid flow which both flow through the device and to minimize or eliminate turbulences and to prevent light materials and the like from flowing back into the fraction or material group of the stones/inert materials/heavy parts.

In a preferred embodiment, it is possible that in a third separation region, the second and a third material group are, at least to some extent, separable from one another by means of the fluid guide plate and are, at least to some extent, separately available on the second conveyor belt.

While the first material group consists of material such as stones, inert materials or heavy parts with the lowest fluid resistance of all material groups of the material mixture, the second material group is the material group with the highest fluid resistance, thus being the easiest to separate from the material flow by means of negative pressure regions. The third material group, which, among others, is separable from the second material group by means of the fluid guide plate, can also consist of stones, inert materials, or heavy parts; however, in contrast to the components of the first material group, the components of the third material group can, on average, be smaller and/or have a fluid dynamic behavior different from the components of the first material group, and therefore are separable from the components of the first material group by means of the airflow generated by the pressure blower, and are furthermore separable from the components of the second material group by means of the fluid guide plate. The fluid guide plate guides the components of the second and third material group along different paths to the second conveyor belt provided below the fluid guide plate, thus resulting in a third separation in a third separation region. The conveyor belt can be designed as discharge conveyor belt, and the second and third material group can be made available separate from one another and horizontally layered on top of one another, but not removed from the material flow, on the second conveyor belt. As a result, the second and third material group are, at least to some extent, separated from one another.

Therefore, in a preferred embodiment, the second material group is the material group with the highest fluid resistance of all material groups of the material mixture and, for example, comprises foils and/or foil parts, wherein the second material group rests, to a great extent, on the third material group on the second conveyor belt arranged downstream of the fluid guide plate.

This results in a pre-separation of the second and third material group which is advantageous for the separation process, wherein the lighter components of the material flow or those which are more easily carried along by the fluid flow, e.g. foils, light materials and/or foil parts, rest on the subjacent component of the third material group which is more difficult to suction off by means of the negative pressure region. Therefore, the stones, inert materials, or other components of the third material group do not rest on the foils and/or foils parts and disadvantageously prevent them from being suctioned by the negative pressure region.

In a further preferred embodiment, it is conceivable that a fourth separation region comprises the second negative pressure region, wherein a part of the second material group still remaining in the material flow is, at least to some extent, separable in a perpendicular direction from a main direction of the material flow by means of the second negative pressure region.

Therefore, the previous separation by means of the fluid guide plate can be used advantageously by means of the second negative pressure region in order to remove the now exposed components of the second material group, which were not separated by the first negative pressure region, from the material flow by means of the second negative pressure region.

In a further preferred embodiment, it is conceivable that negative pressure can be applied to the two negative pressure regions by means of one common pressure source or by means of separate pressure sources.

A simply designed common pressure source, for example, a suction fan, can be advantageous because the entire device can be provided simpler and thus more economically. On the other hand, circumstances are conceivable for which operation with two separate pressure sources is advantageous, for example, because overall higher suction capacities can be achieved or it is possible to dispense with elaborate compressed-air lines from a pressure source to the two negative pressure regions.

The invention further relates to a method for separating a material mixture of a material flow.

At least partial separation of a first material group with the lowest fluid resistance of all material groups of the material mixture from the material flow in a first separation region is performed.

At least partial separation of a second material group is performed by means of a first negative pressure region in a horizontally lateral direction from a main direction of the material flow and from a settling zone in a second separation region.

At least partial separation of the second and a third material group of the material mixture by means of a fluid guide plate in a third separation is performed, such that the second and the third material group are not mixed with the first material group.

At least partial separation of parts of the second material group still remaining in the material flow is performed by means of a second negative pressure region in a perpendicular direction from a main direction of the material flow in a fourth separation region.

The advantages of the method most closely correspond to the aforementioned advantages of the corresponding device and are not repeated.

Further details and advantages of the invention shall be described in more detail by means of the embodiment depicted in the drawings.

DETAILED DESCRIPTION OF THE INVENTION

Figure 1:
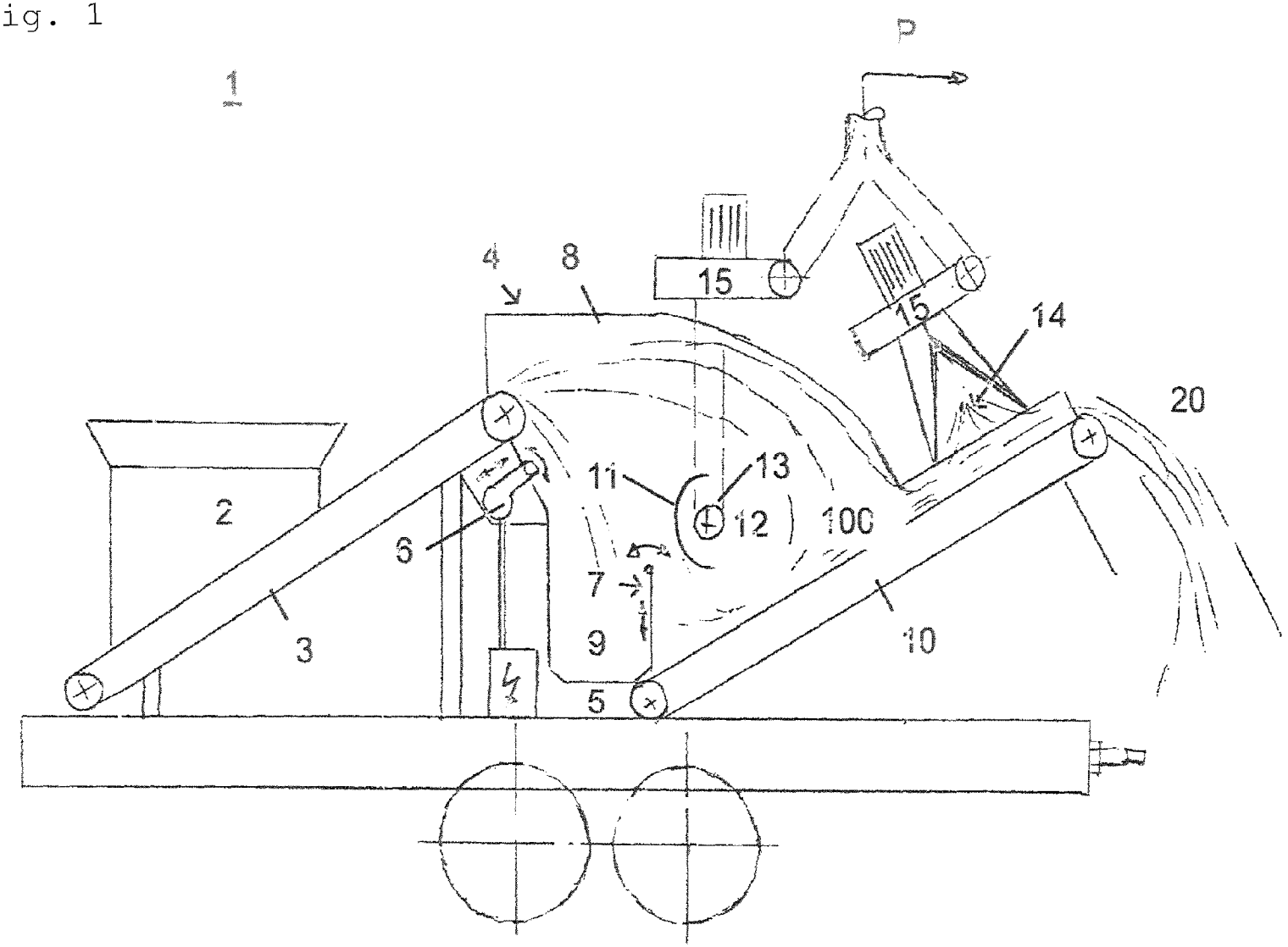
FIG. 1 is a schematic depiction of the stone separator with air separator.

FIG. 1 shows a schematic diagram of the device 1 according to the invention for processing a material mixture. The material mixture is initially introduced into the device 1 by means of a receiving means 2 and guided by the receiving means 2 to a first conveyor belt 3. The first conveyor belt 3 conveys the material mixture into a chamber 4, wherein the material mixture is transported in a direction perpendicularly upward by means of the first conveyor belt 3 such that the material mixture can fall within the chamber 4 in the direction of the chamber floor 5.

During the falling motion of the material mixture, the material mixture is caught by the airflow of a pressure blower 6 which is aimed from below at the material mixture falling into the chamber 4. The components of the material mixture are, according to their fluid resistance, caught and displaced to a greater or lesser extent by the airflow.

In the region of the chamber floor 5, two collecting means are arranged offset along the chamber floor 5 and separated from one another by means of a separating crest 7 arranged on the chamber floor 5. The separating crest 7 extends from the chamber floor 5 approximately in the direction of the chamber upper side 8. The separating crest 7 defines a first separation region 30, in which a first material group, which, for example, can consist of stones, inert materials and/or heavy parts, is divided onto the two collecting means. For such purpose, the separating crest 7 is adjustable, and so its length and its angular position, as indicated by the arrows, can be adjusted in accordance with the properties of the material mixture.

In the depicted embodiment, a collecting container 9 is provided as first collecting means which is located to the left of the separating crest 7 and directly below the right end of the first conveyor belt 3. Of course, instead of the collecting container 9, a conveyor belt, a lateral discharge conveyor belt or any other device, which is suitable for collecting or separating material components, is conceivable. A second conveyor belt 10 to the right of the separating crest 7 is provided as second collecting means in the depicted embodiment.

Above the second conveyor belt 10, a fluid guide plate 11 is provided, on the rear side of which, and thus in its wake, a settling zone 12 is provided. The fluid guide plate 11 prevents, among others, light materials from falling into the stone fraction or the collecting container 9. On the side of the settling zone 12, i.e. perpendicularly to the plane of FIG. 1, extends a first two-part negative pressure region 13, by means of which a second material group can be separated at least to some extent in a direction horizontally lateral from the main direction of the material flow 100.

Those components of the material flow 100 which neither fall into the collecting container 9 now were separated by means of the first negative pressure region 13, are available on the second conveyor belt 10 and are layered separately above one another due to the separation effect of the fluid guide plate 11 and the pressure blower 6.

The components of the material flow 100 caught by the second negative pressure region 14 provided on the second conveyor belt 10 can thus be suctioned off without heavier stones or similar materials resting on lighter foil parts obstructing the suction process.

In the depicted embodiment, negative pressure is applied to the negative pressure regions 13, 14 by separate pressure sources 15. For example, suction fans can be used as pressure sources 15. However, a further embodiment is conceivable, wherein negative pressure is applied to the two negative pressure regions 13, 14 by one common pressure source 15 by means of appropriate pressure lines.

The components of the material flow 100 removed by means of the negative pressure regions 13, 14 can naturally be entirely removed from the material flow 100 and moved to a different storage or disposal device, which is indicated with the arrow "P."

In region 20, all those components of the material flow 100 eventually remain which were neither separated by the negative pressure regions 13, 14 nor by the first separation region 30 with separating crest 7. The remaining components can also be stored in a region or device provided for such purpose.

Figure 2:
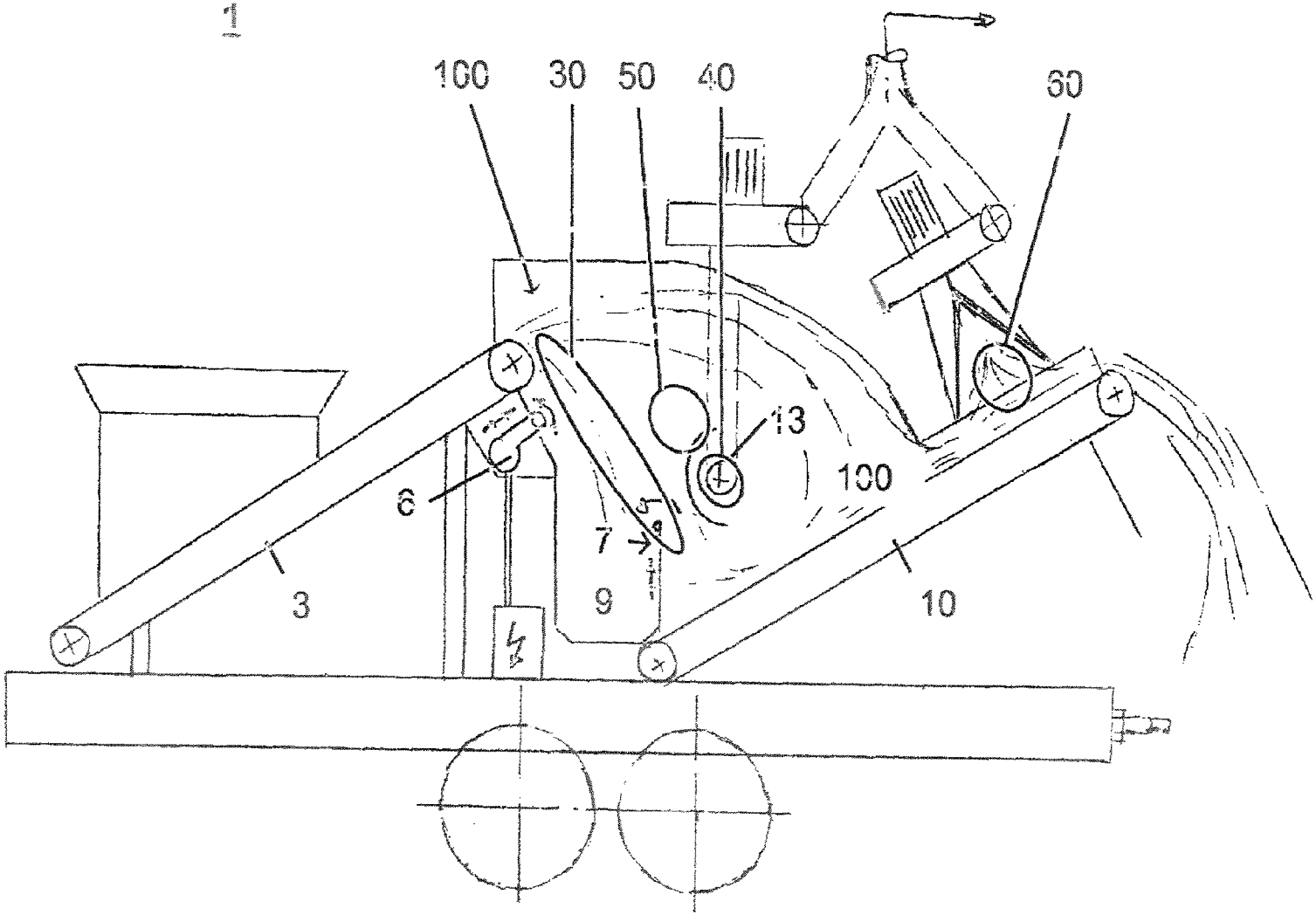
FIG. 2 is a depiction of the separation regions of the stone separator with air separator.

For a better understanding of the arrangement of the individual separation regions 30, 40, 50, 60, FIG. 2 shows a similar depiction of the stone separator with air separator as FIG. 1; however, in the interest of clarity, only the four separation regions 30, 40, 50, 60 and few further components are shown.

In the first separation region 30, the material flow 100, following its main direction from the first conveyor belt 3 to the second conveyor belt 10, is initially caught by the pressure blower 6, as described further above. Components of the material flow 100 which are less likely to be caught by the airflow of the pressure blower 6 are separated by the separating crest 7 between the collecting container 9 and the second conveyor belt 10.

In the second separation region 40, the material flow 100 is further separated. In this case, lighter components of the material flow 100 are removed laterally from the chamber 4 by means of the negative pressure region 13.

The third separation region 50 comprises the fluid guide plate 11, with which the second and third material group can be separated, and so they are, at least to some extent, separately available on the second conveyor belt 10 and, within the framework of the targeted airflow, do not reach the region stones/inert materials/heavy parts due to turbulence.

The fourth and last separation region 60 eventually comprises the second negative pressure region 14 and, in the region of the second conveyor belt 10, removes the remaining light components of the material flow 100 resting on top of the second conveyor belt 10.

The invention claimed is:

1. A device for separating stones, inert materials, and/or heavy parts from a material mixture, comprising:

a first conveyor belt, which is connected to a chamber, at least one pressure blower provided in an internal space of the chamber for generating an airflow aimed from below at the material mixture falling into the chamber, and at least two collecting means arranged offset along a chamber floor at different distances to an entry point of the material mixture which faces the chamber, said collecting means delimited from one another in terms of surface area by at least one separating crest which is movably arranged on the chamber floor and extends from the chamber floor in the direction of a chamber upper side, wherein a first material group with a lowest fluid resistance of all material groups of the material mixture is separable at least to some extent from a material flow in a first separation region, wherein a fluid flow and said material mixture, which has at least three different material groups separable by way of the device, flow as a material stream through the device, and wherein, in a second separation region with a settling zone and a first negative pressure region, a second material group is separable from a main direction of the material flow and the settling zone at least to some extent by way of the first negative pressure region in a horizontally lateral direction.

2. The device according to claim 1, wherein at least a second conveyor belt, at least one fluid guide plate, a second negative pressure region, and, overall, at least four separation regions are provided.

3. The device according to claim 2, wherein, in a third separation region, the second material group and a third material group are, at least to some extent, separable from one another by way of the fluid guide plate and, at least to some extent, are separately available on the second conveyor belt.

4. The device according to claim 2, wherein the second material group is the material group with the highest fluid resistance of all material groups of the material mixture, and comprises foils and/or foil parts, and wherein the second material group rests, to a great extent, on the third material group on the second conveyor belt arranged downstream of the fluid guide plate.

5. The device according to claim 3, wherein a fourth separation region comprises the second negative pressure region, and wherein a part of the second material group still remaining in the material flow is, at least to some extent, separable in a perpendicular direction from a main direction of the material flow by way of the second negative pressure region.

6. The device according to claim 2, wherein negative pressure can be applied to the first and second negative pressure regions by a common pressure source.

7. The device according to claim 2, wherein negative pressure can be applied to the first and second negative pressure regions by separate pressure sources.

* * * * *